US009465355B2

(12) United States Patent
Iizuka

(10) Patent No.: US 9,465,355 B2
(45) Date of Patent: Oct. 11, 2016

(54) IMAGE FORMING APPARATUS

(71) Applicant: CANON KABUSHIKI KAISHA, Tokyo (JP)

(72) Inventor: Yoichiro Iizuka, Hanoi (VN)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/857,469

(22) Filed: Sep. 17, 2015

(65) Prior Publication Data

US 2016/0085206 A1 Mar. 24, 2016

(30) Foreign Application Priority Data

Sep. 22, 2014 (JP) ..... 2014-192238

(51) Int. Cl.
*G03G 15/20* (2006.01)
*G03G 21/18* (2006.01)

(52) U.S. Cl.
CPC ..... *G03G 21/1842* (2013.01)

(58) Field of Classification Search
CPC ..... G03G 15/0189; G03G 21/1623; G03G 21/1647; G03G 21/1661; G03G 21/1842
See application file for complete search history.

(56) References Cited

U.S. PATENT DOCUMENTS

2010/0080618 A1* 4/2010 Suzuki ..... G03G 21/1853 399/112

FOREIGN PATENT DOCUMENTS

| | | | |
|---|---|---|---|
| JP | 2007-093830 | A | 4/2007 |
| JP | 2008-165027 | A | 7/2008 |
| JP | 2010-054814 | A | 3/2010 |
| JP | 2010-181766 | A | 8/2010 |
| JP | 2012-198444 | A | 10/2012 |
| JP | 2013-020108 | A | 1/2013 |
| JP | 2014-106392 | A | 6/2014 |

* cited by examiner

*Primary Examiner* — Roy Y Yi
(74) *Attorney, Agent, or Firm* — Canon U.S.A. Inc., IP Division

(57) ABSTRACT

An image forming apparatus includes a main body of the apparatus, a cartridge support member, an openable and closable member configured to open and close an opening portion, a linkage mechanism configured to link the openable and closable member and the cartridge support member to each other, and a locking portion configured to prevent the cartridge support member from being detached from the main body of the apparatus. The locking of the cartridge support member by the locking portion is released by releasing the linkage by the linkage mechanism to move the cartridge support member relative to the locking portion.

15 Claims, 15 Drawing Sheets

IMAGE FORMING APPARATUS

BACKGROUND OF THE INVENTION

1. Field of the Invention

The present invention relates to an image forming apparatus.

In this specification, an image forming apparatus represents an apparatus for forming an image on a recording medium, and examples of the image forming apparatus include an electrophotographic copying machine, an electrophotographic printer (e.g., a laser printer or a light-emitting diode (LED) printer), a facsimile device, and a word processor.

2. Description of the Related Art

An image forming apparatus using an electrophotographic process, such as a printer, uniformly charges an electrophotographic photosensitive member serving as an image bearing member, and forms a latent image on the photosensitive member with a selective exposure thereto. The latent image is then developed with a developer and visualized as a developer image. The developer image is then transferred onto a recording medium. The image forming apparatus applies heat and pressure to the transferred developer image to fix the developer image to the recording medium, thereby performing image recording.

Conventionally, the image forming apparatus of this type has been covered by a housing, and an opening portion for replenishment of a developer or maintenance for various process units is formed on a part of the housing. In addition, some of the image forming apparatuses are configured in such a way that the developer and various process units are stored in a pullout member (cartridge support member), and the developer and the various process units can easily be removed from a main body of the apparatus by pulling out the pullout member. Such a configuration is discussed in Japanese Patent Application Laid-Open No. 2008-165027.

The pullout member described above is located inside the main body of the apparatus during normal image formation, and in order to take out the developer or the various process units, a door for opening and closing the apparatus, which is supported to be openable and closable by the main body of the apparatus, is opened and then the pullout member is pulled out to a predetermined position.

The pullout member (cartridge support member) described above is locked to prevent it from being further pulled out after being pulled out to the predetermined position. This prevents the pullout member from falling from the main body of the apparatus.

On the other hand, at the time of assembling the apparatus, the pullout member needs to be attached to the main body of the apparatus. It is necessary that a locking portion is a detachable component or is elastically deformable to allow the pullout member to be attached to or detached from the main body of the apparatus. In view of this, conceivable configurations include the one in which a locking component for locking the pullout member is provided in the main body of the apparatus, and the one in which a component made of an elastic material and having a different function is formed to have an elastically deformable shape for use as a locking portion. More specifically, with these configurations, the locking portion can be removed at the time of attaching the pullout member, or the locking portion is elastically deformed to allow the pullout member to be attached to the main body of the apparatus when attaching the pullout member to the main body of the apparatus.

However, the configuration in which the locking portion is formed to be removable or the configuration in which the locking portion is formed to have elasticity may cause cost increase. Also, limitations may be imposed on the shape, size, or arrangement of the locking portion in order to prevent the reduction in strength of the locking portion.

SUMMARY OF THE INVENTION

The present invention is directed to a novel image forming apparatus achieving a lock state and release of the lock state of a cartridge support member.

According to an aspect of the present invention, an image forming apparatus includes a main body of the apparatus, a cartridge support member configured to move between an inside and an outside of the main body of the apparatus while supporting a cartridge, an opening portion through which the cartridge support member passes, the opening portion being provided in the main body of the apparatus, an openable and closable member configured to open and close the opening portion, a linkage mechanism configured to link the openable and closable member and the cartridge support member to each other, the linkage mechanism moving the cartridge support member to a first position when the openable and closable member is opened, and moving the cartridge support member to a second position different from the first position when the openable and closable member is closed, and a locking portion configured to lock the cartridge support member moved to the outside of the main body of the apparatus to prevent the cartridge support member from being detached from the main body of the apparatus. The locking of the cartridge support member by the locking portion is released by releasing the linkage between the cartridge support member and the openable and closable member by the linkage mechanism to move the cartridge support member relative to the locking portion.

Further features of the present invention will become apparent from the following description of exemplary embodiments with reference to the attached drawings.

DESCRIPTION OF THE EMBODIMENTS

A first exemplary embodiment of the present invention will be described below with reference to the drawings.

In the present exemplary embodiment, a full-color electrophotographic image forming apparatus to which four process cartridges are detachably attached is described as an example of an electrophotographic image forming apparatus.

However, the number of process cartridges to be attached to the electrophotographic image forming apparatus (hereinafter referred to as the image forming apparatus) is not limited to four. This number is appropriately set as needed.

For example, in the case of an image forming apparatus that forms a monochrome image, the number of process cartridges to be attached to the image forming apparatus is one. Also in the present exemplary embodiment, a printer is described as an example of the image forming apparatus.

However, the present exemplary embodiment is not limited thereto. The present exemplary embodiment is applicable to other image forming apparatuses such as a copying machine and a facsimile machine, or other image forming apparatuses such as a multifunction peripheral having these functions in combination.

<Schematic Configuration of Image Forming Apparatus>

Figure 1:
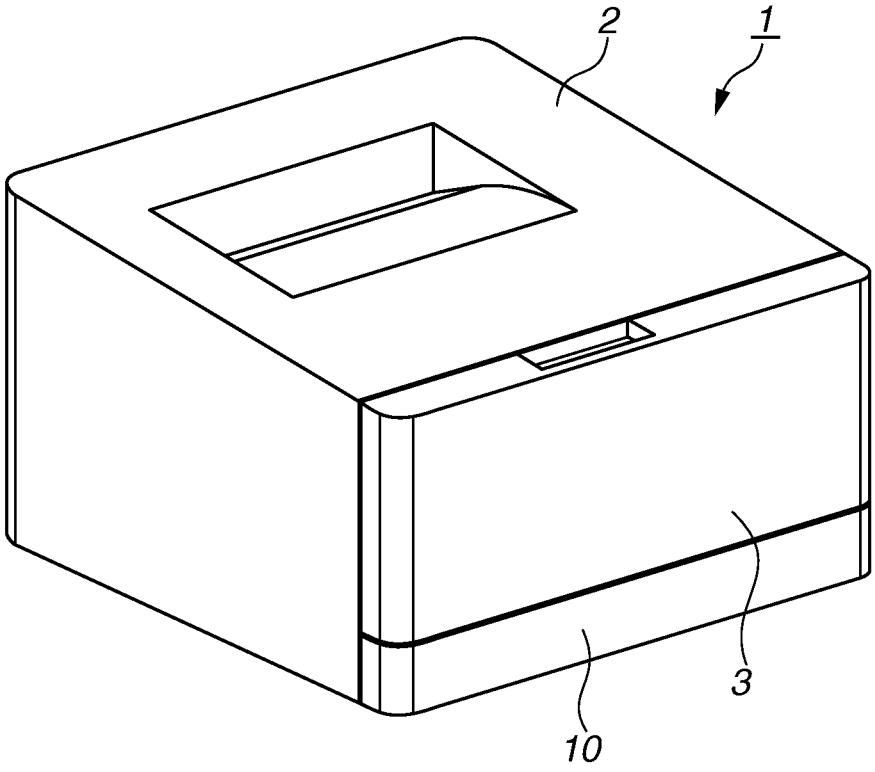
FIG. 1 is a perspective view illustrating an example of an electrophotographic image forming apparatus.
Figure 2:
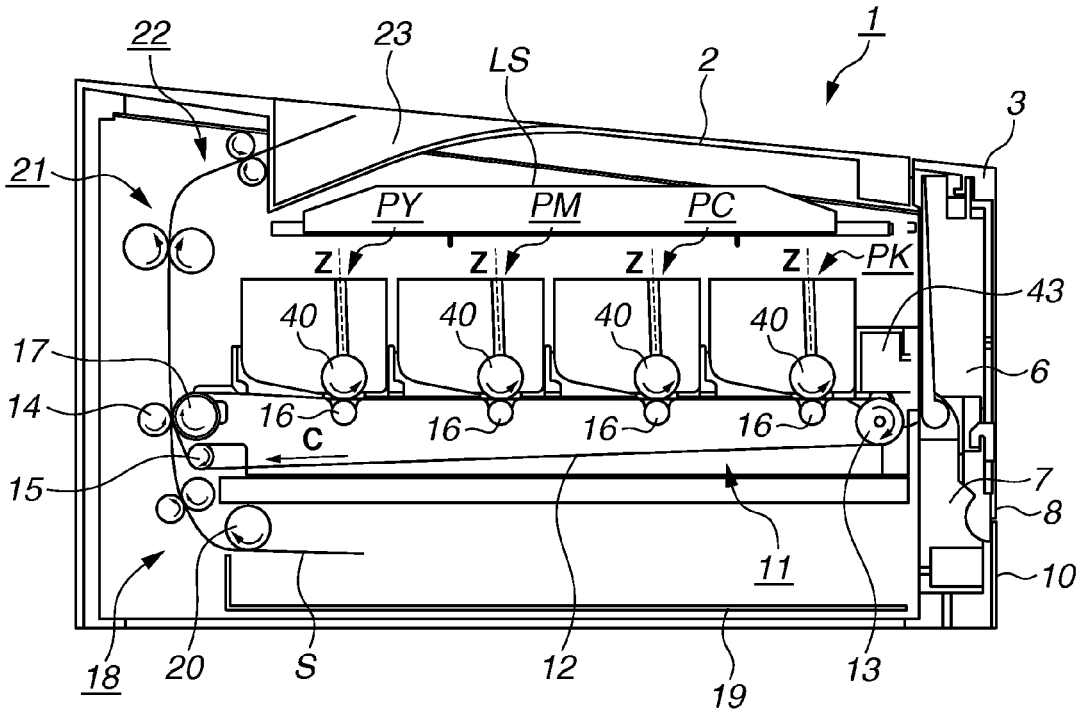
FIG. 2 is a schematic sectional view illustrating an example of the electrophotographic image forming apparatus.

FIGS. 1 and 2 illustrate a perspective view and a schematic sectional view of an image forming apparatus according to the present exemplary embodiment, respectively.

An image forming apparatus 1 is a four-full-color laser printer using an electrophotographic process, and performs color image formation on a recording medium. The image forming apparatus 1 is a process cartridge type, wherein a process cartridge P (hereinafter referred to as a cartridge) is detachably attached to a main body 2 of the image forming apparatus 1 to form a color image on a recording medium S.

For the image forming apparatus 1, it is assumed here that the side at which a door 3 for opening and closing the image forming apparatus 1 (hereinafter referred to as an openable and closable door 3) is provided is defined as a front side (front surface), and the side opposite to the front side is defined as a back side (back surface). Further, the right side of the image forming apparatus 1 when viewed from the front side is defined as a drive side, and the left side is defined as a non-drive side. A drive mechanism for transmitting a drive force from the main body 2 of the image forming apparatus 1 to the cartridge P is mounted on the drive side.

Four cartridges P (PY, PM, PC, PK), including a first cartridge PY, a second cartridge PM, a third cartridge PC, and a fourth cartridge PK, are horizontally disposed in the main body 2 of the image forming apparatus 1.

Each of the first to fourth cartridges P (PY, PM, PC, PK) has a similar electrophotographic process mechanism, and stores a developer (hereinafter referred to as toner) of a different color. A rotation drive force is transmitted to the first to fourth cartridges P (PY, PM, PC, PK) from a drive output unit (not illustrated) of the main body 2 of the image forming apparatus 1.

A bias voltage (such as a charging bias or a developing bias) is supplied to the first to fourth cartridges P (PY, PM, PC, PK) from the main body 2 of the image forming apparatus 1, which is not illustrated.

The first cartridge PY stores yellow (Y) toner, and forms a toner image of a yellow color on a surface of a photosensitive drum 40.

The second cartridge PM stores magenta (M) toner, and forms a toner image of a magenta color on the surface of the photosensitive drum 40.

The third cartridge PC stores cyan (C) toner, and forms a toner image of a cyan color on the surface of the photosensitive drum 40.

The fourth cartridge PK stores black (K) toner, and forms a toner image of a black color on the surface of the photosensitive drum 40.

A laser scanner unit LS serving as an exposure unit is provided above the first to fourth cartridges P (PY, PM, PC, PK). The laser scanner unit LS outputs a laser light Z according to image information. The surface of the photosensitive drum 40 is then scanned and exposed with the laser light Z that has passed through an exposure window of each of the cartridges P.

An intermediate transfer belt unit 11 serving as a transfer member is provided below the first to fourth cartridges P (PY, PM, PC, PK). The intermediate transfer belt unit 11 includes a drive roller 13, a turn roller 17, and a tension roller 15. The intermediate transfer belt unit 11 further includes a transfer belt 12 having flexibility which is stretched over the drive roller 13, the turn roller 17, and the tension roller 15.

The lower surface of the photosensitive drum 40 in each of the first to fourth cartridges P (PY, PM, PC, PK) is in contact with the upper surface of the transfer belt 12. The contact portion is a primary transfer portion. A primary transfer roller 16 is provided to face the photosensitive drum 40 at the inner side of the transfer belt 12.

A secondary transfer roller 14 is brought into contact with the turn roller 17 via the transfer belt 12. The contact portion between the transfer belt 12 and the secondary transfer roller 14 is a secondary transfer portion.

A feeding unit 18 is provided below the intermediate transfer belt unit 11. The feeding unit 18 includes a sheet feed tray 19 for storing stacked recording media S and a sheet feeding roller 20.

A fixing unit 21 and a discharge unit 22 are provided at the upper left of the main body 2 of the image forming apparatus 1. The upper surface of the main body 2 of the image forming apparatus 1 serves as a discharge tray 23.

A toner image is fixed to the recording medium S by a fixing portion provided in the fixing unit 21, and the recording medium S is then discharged onto the discharge tray 23.

<Image Forming Operation>

An operation for forming a full-color image will be described below.

The photosensitive drum 40 in each of the first to fourth cartridges P (PY, PM, PC, PK) is rotationally driven at a predetermined speed (in a direction indicated by an arrow illustrated in FIG. 2, i.e., a counterclockwise direction).

The transfer belt 12 is also rotationally driven at a speed corresponding to the speed of the photosensitive drum 40 in a forward direction (direction indicated by an arrow C illustrated in FIG. 2) of the rotation of the photosensitive drum 40.

The laser scanner unit LS scans and exposes the surface of the photosensitive drum 40 in each of the cartridges P with the laser light Z according to an image signal of a color corresponding to each of the cartridges P.

With this, an electrostatic latent image according to the image signal of the corresponding color is formed on the surface of the photosensitive drum 40 in each of the cartridges P. The formed electrostatic latent image is developed by a developing roller (not illustrated) rotationally driven at a predetermined speed.

With the above-described electrophotographic image forming process, a toner image of a yellow color corresponding to a yellow component in a full-color image is formed on the photosensitive drum 40 in the first cartridge PY. Then, the toner image is primarily transferred onto the transfer belt 12.

Similarly, a toner image of a magenta color corresponding to a magenta component in the full-color image is formed on the photosensitive drum 40 in the second cartridge PM. Then, the toner image is primarily transferred while being superimposed on the yellow toner image already transferred on the transfer belt 12.

Similarly, a toner image of a cyan color corresponding to a cyan component in the full-color image is formed on the photosensitive drum 40 in the third cartridge PC. Then, the toner image is primarily transferred while being superimposed on the yellow toner image and the magenta toner image, which have already been transferred on the transfer belt 12.

Similarly, a toner image of a black color corresponding to a black component in the full-color image is formed on the photosensitive drum 40 in the fourth cartridge PK. Then, the toner image is primarily transferred while being superimposed on the yellow toner image, the magenta toner image, and the cyan toner image, which have already been transferred on the transfer belt 12.

In this way, a non-fixed full-color toner image of four colors of yellow, magenta, cyan, and black is formed on the transfer belt 12.

On the other hand, the recording media S is separated and fed one by one at a predetermined control timing. The recording medium S is guided to the secondary transfer portion that is the contact portion between the secondary transfer roller 14 and the transfer belt 12 at a predetermined control timing.

Thus, the toner image formed by superimposing the four colors on the transfer belt 12 is sequentially transferred collectively on the surface of the recording medium S in a process of conveying the recording medium S to the secondary transfer portion.

<Configuration for Attachment/Detachment of Cartridge>

Next, an operation of attaching/detaching the cartridges P (PY, PM, PC, PK) to/from the main body 2 of the image forming apparatus 1 will be described.

Figure 3A:
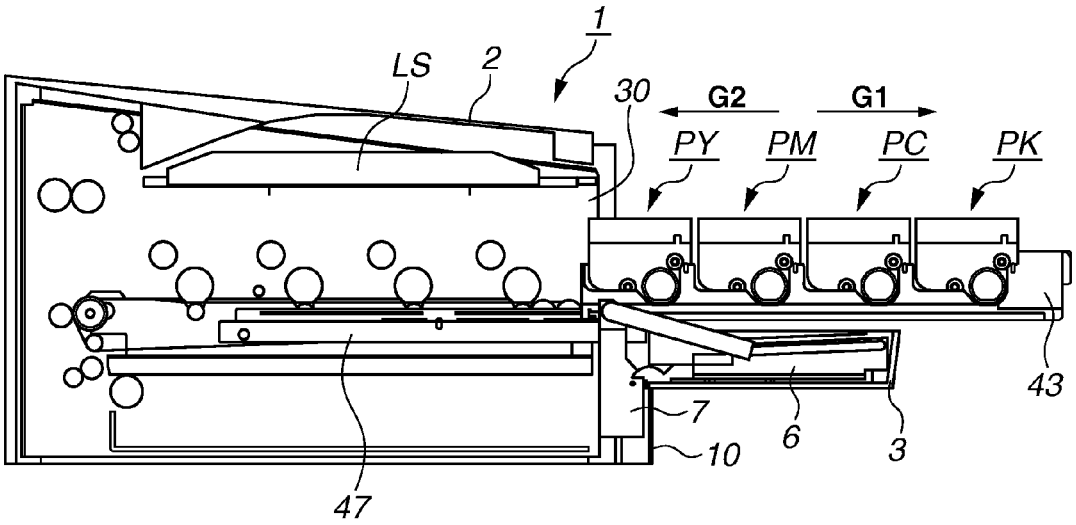
FIGS. 3A and 3B are sectional views each illustrating an example of the electrophotographic image forming apparatus.
Figure 3B:
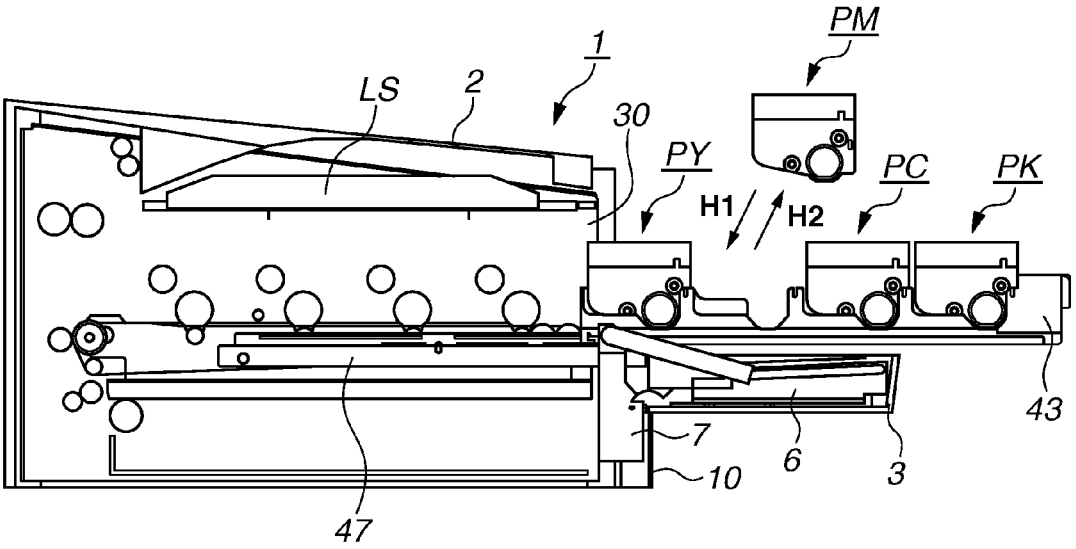

FIG. 3A is a schematic sectional view illustrating a state where a cartridge tray 43 is pulled out of the main body 2 of the image forming apparatus 1, so that the cartridges P are detachable. FIG. 3B is a schematic sectional view illustrating the operation of attaching/detaching the cartridges P to/from the cartridge tray 43.

The cartridge tray 43 to which the cartridges P can be attached is provided in the main body 2 of the image forming apparatus 1. As illustrated in FIG. 3A, the cartridge tray 43 is configured to be linearly movable (capable of being pushed in/pulled out) in directions, indicated by arrows G1 and G2, that are substantially horizontal relative to the main body 2 of the image forming apparatus 2.

More specifically, the cartridge tray 43 is held on a rail member 47 so as to be slidable. The rail member serves as a guide member for guiding the moving direction of the cartridge tray 43, and also serves as a holding member for holding the cartridge tray 43.

The cartridge tray 43 can be positioned at an installation position inside the main body 2 of the image forming apparatus 1 and a pullout position where the cartridge tray 43 is pulled out of the main body 2 of the image forming apparatus 1. In other words, the cartridge tray 43 serves as a pullout member that can be pulled out of the main body 2 of the image forming apparatus 2, and also serves as a cartridge support member for supporting a plurality of the cartridges P.

The state in which the cartridge tray 43 is at the installation position means that the cartridge tray 43 is installed into the main body 2 of the image forming apparatus 1. In this case, the cartridges P supported by the cartridge tray 43 are also inserted into the main body 2 of the image forming apparatus 1.

On the other hand, the state in which the cartridge tray 43 is at the pullout position (outside position) means that the cartridge tray 43 is pulled outside the main body 2 of the image forming apparatus 1. In this case, the cartridges P supported by the cartridge tray 43 are exposed to the outside of the main body 2 of the imager forming apparatus 1, so that the cartridges P can be detached from the cartridge tray 43. While the cartridge tray 43 is at the pullout position, the cartridges P can also be attached to the cartridge tray 43. More specifically, the pullout position (outside position) of the cartridge tray 43 is the position (cartridge attachment/detachment position) where the cartridges P can be attached to or detached from the cartridge tray 43.

First, the operation of attaching the cartridges P (PY, PM, PC, PK) to the main body 2 of the image forming apparatus 1 will be described.

The cartridge tray 43 is moved to the pullout position by opening the openable and closable door 3 and moving the cartridge tray 43 in the direction indicated by the arrow G1 illustrated in FIG. 3A (in the pulling direction of the cartridge tray 43). In this state, the cartridges P can be attached to the cartridge tray 43 from a direction indicated by an arrow H1 illustrated in FIG. 3B, and held. The openable and closable door 3 is an openable and closable member for opening/closing an opening portion 30 of the image forming apparatus 1 formed on the main body of the image forming apparatus 1, that is, an opening portion through which the cartridge tray 43 passes.

The cartridge tray 43 that holds the cartridges P moves in the direction indicated by the arrow G2 illustrated in FIG. 3A (in the installation direction of the cartridge tray 43), so that the cartridge tray 43 moves to the installation position inside the main body 2 of the image forming apparatus 1. Then, the openable and closable door 3 is closed, whereby the operation of attaching the cartridges P to the main body 2 of the image forming apparatus 1 is completed.

The detachment of the cartridges P from the main body 2 of the image forming apparatus 1 will be described below.

The cartridge tray 43 is moved to the pullout position in a way similar to the above-described operation of attaching the cartridges P to the main body 2 of the image forming apparatus 1. In this state, the cartridges P are detached in a direction indicated by an arrow H2 illustrated in FIG. 3B, whereby the operation of detaching the cartridges P from the main body 2 of the image forming apparatus 2 is completed.

With the above-described operations, the cartridges P can be attached/detached to/from the main body 2 of the image forming apparatus 1.

<Configuration for Movement of Cartridge Tray>

Figure 7A:
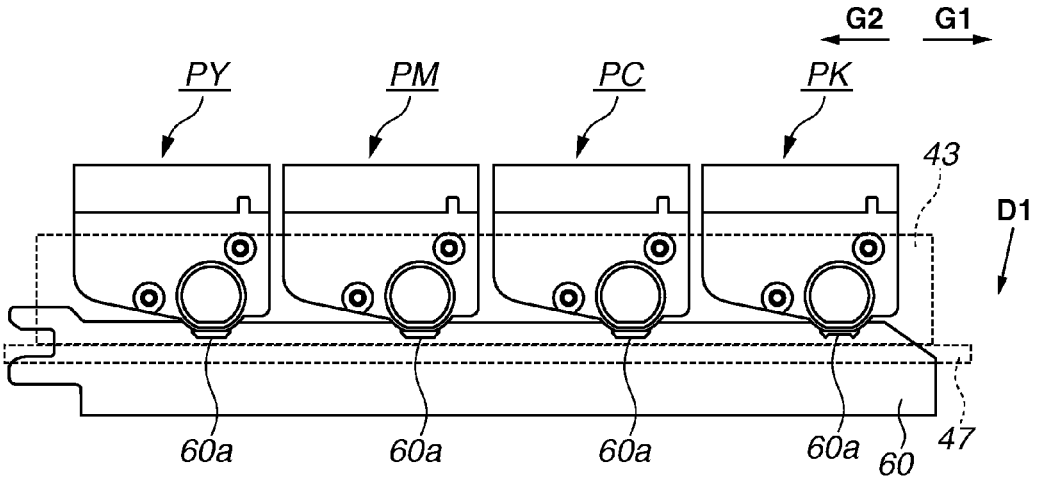
FIGS. 7A and 7B are a side view illustrating an example of a state where cartridges are placed on a positioning member, and a side view illustrating an example of a state where the cartridges can be inserted or removed, respectively.
Figure 7B:
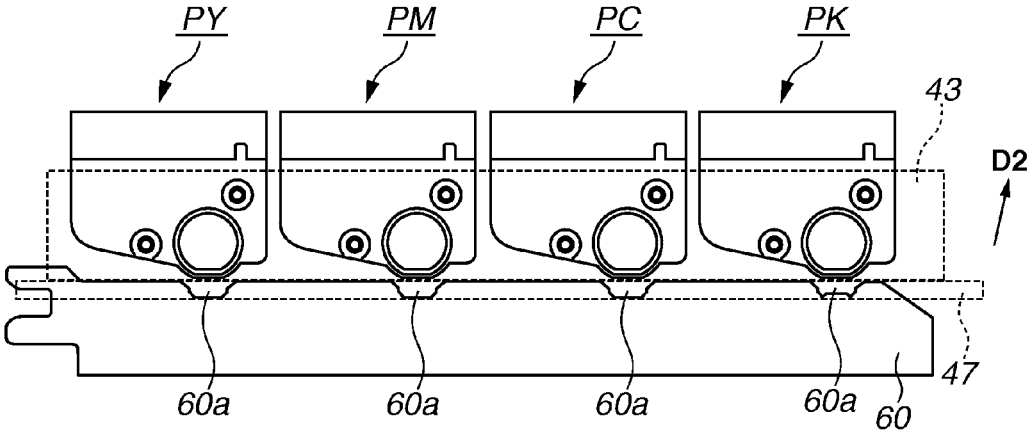

During the image formation, the cartridges P are disposed to be in contact with (to be engaged with) positioning portions 60*a* of a cartridge positioning member 60 as illustrated in FIG. 7A. Therefore, in order to pull out the cartridge P with the cartridge tray 43, it is necessary to lift the cartridges P to the height at which the cartridges P are movable in the pullout direction without interfering with the cartridge positioning member 60 as illustrated in FIG. 7B.

Figure 8:
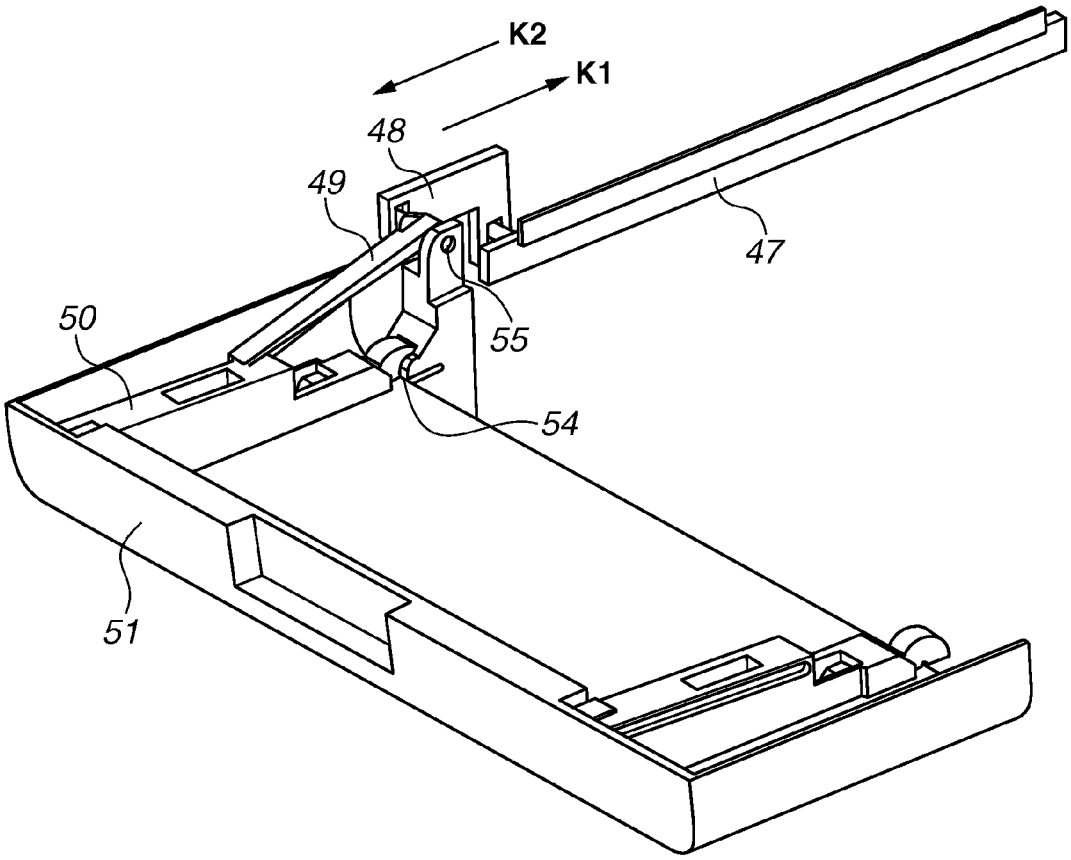
FIG. 8 is a perspective view illustrating an example in which a rail member, a connection member, and a door linkage member are connected to one another.

As illustrated in FIG. 8, the openable and closable door 3 is composed of at least a door hinge member 50 and a cover member 51. The door hinge member 50 swings about a rotation center 54, relative to the main body 2 of the image forming apparatus 2.

As illustrated in FIG. 8, a connection member 48 is engaged with a door linkage member 49. The connection member 48 is a member for connecting the door linkage member 49 to the rail member 47.

The door linkage member 49 swings about a rotation center 55, relative to the main body 2 of the image forming apparatus 1. With the swing of the door linkage member 49, the connection member 48 performs a translational movement in a direction indicated by an arrow K1 or K2. The rail member 47 is engaged with the connection member 48, and moves in the direction K1 or K2 with the translational movement of the connection member 48.

Figure 9:
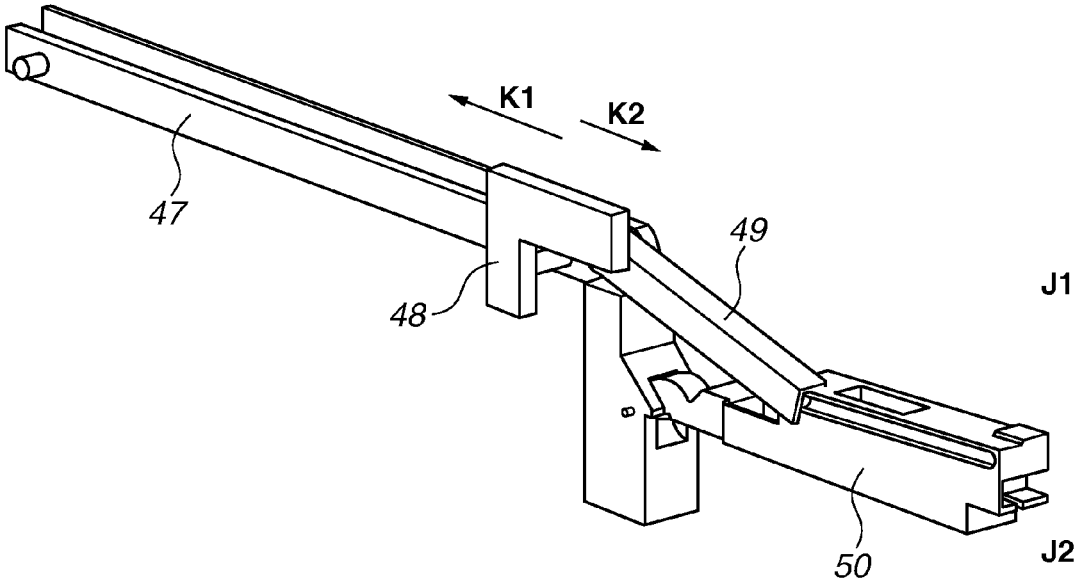
FIG. 9 is a perspective view illustrating an example of connection between the door linkage member and a door hinge member.

As illustrated in FIG. 9, the door linkage member 49 is engaged with the door hinge member 50, so that the door linkage member 49 swings with the swing of the door hinge member 50. With the engagement from the door hinge member 50 to the connection member 48, the connection member 48 moves in the directions K1 and K2, together with the opening and closing action of the openable and closable door 3 in directions J1 and J2 illustrated in FIG. 9, respectively.

Figure 10:
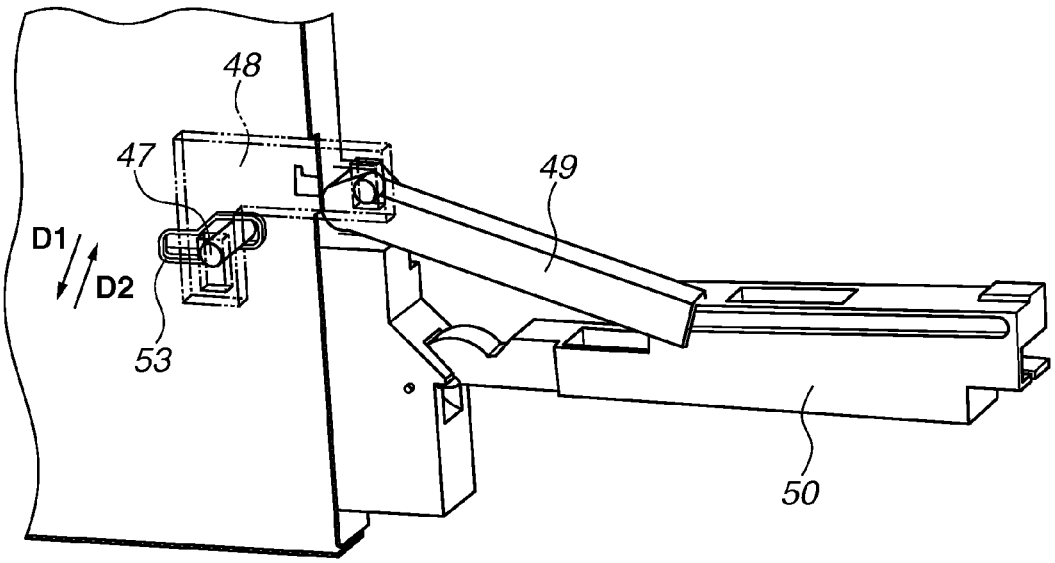
FIG. 10 is a perspective view illustrating an example in which the rail member is guided by a groove.

In this case, as illustrated in FIG. 10, a guide shape 53 formed on the main body 2 of the image forming apparatus 1 allows the rail member 47 linked with the connection member 48 to move in the vertical direction as well as in the longitudinal direction. More specifically, when the openable and closable door 3 is opened, the rail member 47 moves in an oblique direction (direction indicated by an arrow D2). Similarly, when the openable and closable door 3 is closed, the rail member 47 moves in an oblique direction (direction indicated by an arrow D1).

More specifically, the openable and closable door is connected to the rail member 47 via the door hinge member 50, the door linkage member 49, and the connection member 48, so that the rail member 47 moves with the opening/closing of the openable and closable door 3. In addition, the cartridge tray 43 is supported (held) by the rail member 47, so that the cartridge tray 43 moves with the opening/closing of the openable and closable door 3.

The door hinge member 50, the door linkage member 49, the connection member 48, and the rail member 47 are a linkage mechanism that allows the opening and closing action of the openable and closable door 3 and the moving action of the cartridge tray 43 to interact with each other. The door linkage member 49, the connection member 48, and the rail member 47 are a movable member that is connected to the door hinge member 50 of the openable and closable door 3 to cause the cartridge tray 43 to ascend or descend.

With the above-described configuration, when the openable and closable door 3 is opened, the cartridge tray 43 placed on the rail member 47 ascends. Therefore, the cartridge tray 43 lifts the cartridges P up to an upper position where the cartridges P do not interfere with the cartridge positioning member 60 as illustrated in FIG. 7B. Thus, the cartridge tray 43 becomes slidable relative to the main body 2 of the image forming apparatus 1. More specifically, when the openable and closable door 3 is brought into the open state, the cartridge tray 43 becomes movable in the directions indicated by the arrows G1 and G2 between the inside (installation position) and the outside (pullout position) of the main body 2 of the image forming apparatus 2 while holding the cartridges P.

When the openable and closable door 3 is brought into the closed state (when the openable and closable door is closed), the cartridge tray 43 placed on the rail member 47 descends to a lower position where the cartridge tray 43 does not interfere with the cartridges P as illustrated in FIG. 7A. In this state, the cartridges P supported by the cartridge tray 43 are positioned on the positioning portions 60*a* of the cartridge positioning member 60 in the main body 2 of the image forming apparatus 1. As a result, the cartridges P are positioned in a state where image formation is possible. More specifically, when the openable and closable door 3 is closed, the cartridge tray 43 moves the cartridges P to the position where image formation is possible.

FIGS. 7A and 7B schematically illustrate the arrangement of the cartridge tray 43 and the rail member 47 with dotted lines. FIG. 7A illustrates a state where the cartridge tray 43 and the rail member 47 move (descend) in the direction indicated by the arrow D1 by closing the openable and closable door 3. On the other hand, FIG. 7B illustrates a state where the cartridge tray 43 and the rail member 47 move (ascend) in the direction indicated by the arrow D2 by opening the openable and closable door 3.

Figure 15A:
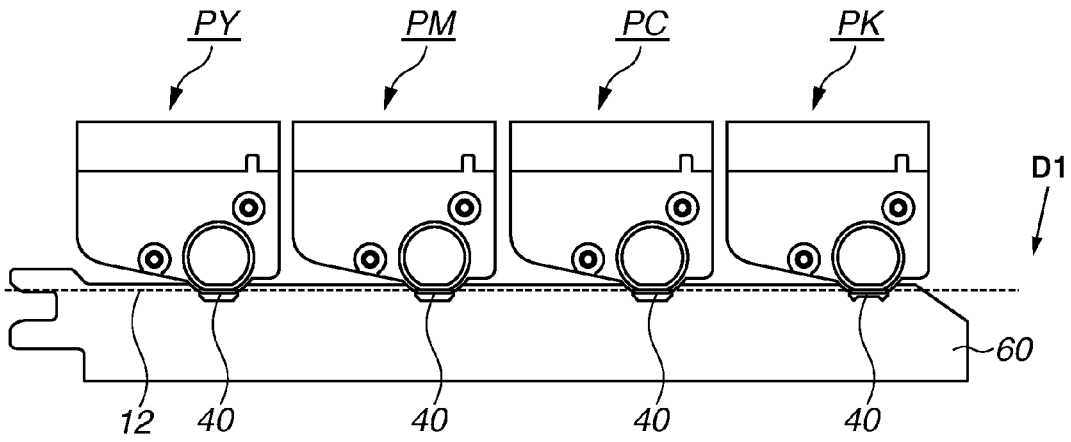
FIGS. 15A and 15B are side views each illustrating an arrangement of the cartridges.
Figure 15B:
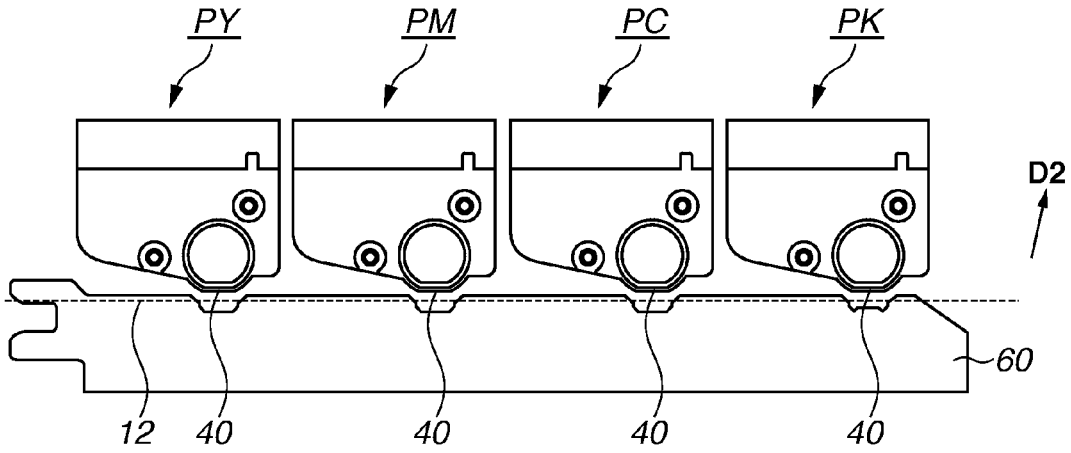

FIGS. 15A and 15B each indicate the position of the transfer belt 12 with a dotted line.

When the cartridge tray 43 moves from the installation position to the image forming position, the photosensitive drum 40 in each of the cartridges P is changed from the state of being separated from the transfer belt (belt member) 12 (see FIG. 15B) to the state of being in contact with the transfer belt 12 (see FIG. 15A). This enables the toner image formed on the photosensitive drum 40 to be primarily transferred onto the transfer belt 12. In other words, the cartridges P are brought into the state where image formation is possible.

In summary, when the openable and closable door 3 is closed, the cartridge tray 43 moves from the installation position (the position where the cartridge tray 43 is pushed inside the main body 2 of the image forming apparatus 1) to the image forming position (the position where the cartridges P are brought into the state where image formation is possible). On the other hand, when the openable and closable door 3 is opened, the cartridge tray 43 moves from the image forming position to the installation position. When a user pulls the cartridge tray 43 in this state, the cartridge tray 43 is pulled out to the outside position (see FIG. 14, etc.)

In this case, the direction in which the cartridge tray 43 moves between the installation position (see FIG. 7B) and the image forming position (see FIG. 7A) is directions indicated by the arrows D1 and D2 illustrated in FIGS. 7A and 7B, respectively. The directions indicated by the arrows D1 and D2 are different from the directions indicated by the arrows G1 and G2 (see FIG. 3A) in which the cartridge tray 43 moves between the installation position and the image forming position. More specifically, the arrow D1 (D2) crosses the arrow G1 (G2).

<Locking Configuration of Cartridge Tray>

Next, a configuration for locking the cartridge tray 43 will be described.

The configuration will be described below by mainly referring to the figures for the non-drive side of the main body 2 of the image forming apparatus 1. However, the drive side has a similar configuration to that of the non-drive side.

Figure 4:
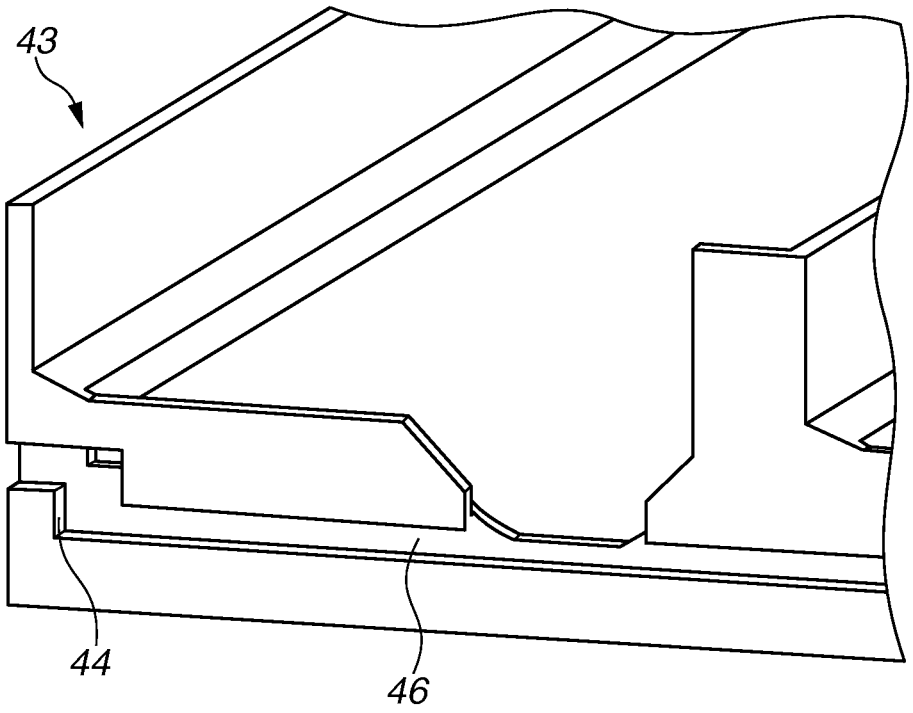
FIG. 4 is a perspective view illustrating an example of a cartridge tray.
Figure 5:
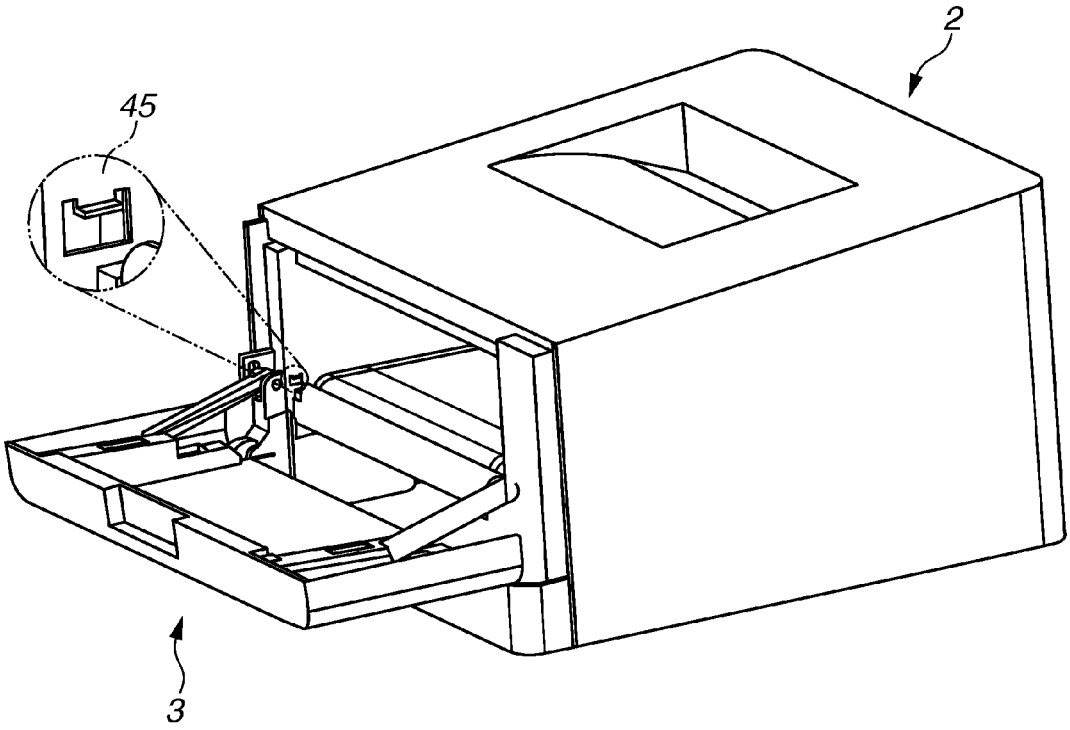
FIG. 5 is a perspective view illustrating an example of a shape for locking the cartridge tray.

FIG. 4 is a perspective view illustrating a back end of the cartridge tray 43 in the pullout direction. The cartridge tray 43 has a locking surface (locked portion) 44 as illustrated in FIG. 4. The main body 2 of the image forming apparatus 1 has a locking shape (locking portion) as illustrated in FIG. 5. The locking shape 45 is configured to restrict a pullout amount of the cartridge tray 43. More specifically, when the cartridge tray 43 is pulled out of the main body 2 of the image forming apparatus 1 by a predetermined amount (predetermined distance), the locking shape 45 makes contact with the locking surface 44. Therefore, the locking shape 45 prevents the cartridge tray 43 from being further pulled out. In other words, the locking shape 45 locks the cartridge tray 43 while being at the pullout position to inhibit the cartridge tray 43 from further moving in the pullout direction G1.

When the cartridge tray 43 moves between the installation position and the pullout position, the locking shape 45 passes through a groove 46 of the cartridge tray 43, so that the locking shape 45 does not prevent the movement of the cartridge tray 43. On the other hand, while the cartridge tray 43 is at the pullout position, the locking surface 44 makes contact with the locking shape 45 to prevent the cartridge tray 43 from being further pulled out, whereby the cartridge tray 43 is locked.

Figure 6:
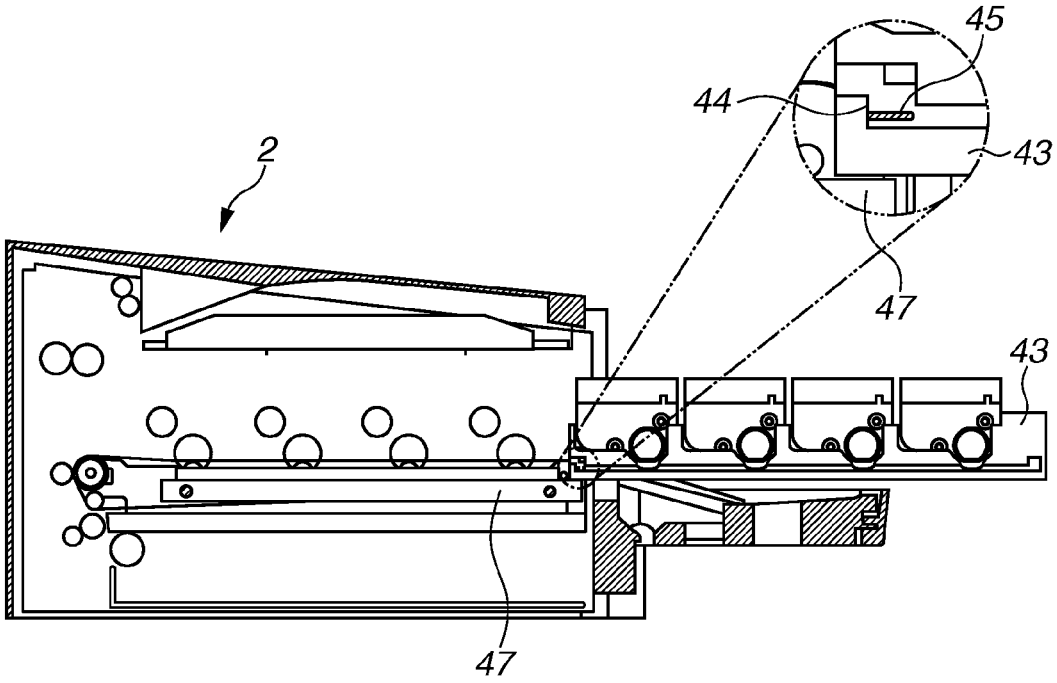
FIG. 6 is a perspective view illustrating an example of locking the cartridge tray.

As illustrated in FIG. 6, the cartridge tray 43 is supported by the rail member 47. The space between the locking shape 45 and the rail member 47 is sufficiently smaller than the width of the locking surface 44. Therefore, even if the locking surface 44 tilts due to the rotation of the cartridge tray 43 around the locking shape 45, the engagement between the locking surface 44 and the locking shape 45 cannot be released.

<Detachment/Attachment Method of Cartridge Tray 43>

As described above, while being at the pullout position, the cartridge tray 43 is locked to the locking shape 45, so that the detachment of the cartridge tray 43 from the main body 2 of the image forming apparatus 1 is prevented.

However, there may be a case where the cartridge tray 43 needs to be detached from the main body 2 of the image forming apparatus 1 for the reason of maintenance, for example. The cartridge tray 43 also needs to be attached to the main body 2 of the image forming apparatus in order to assemble the image forming apparatus. In this case, it is necessary that the cartridge tray 43 can be attached to the main body 2 of the image forming apparatus 1 without being interfered with the locking shape 45.

Accordingly, while the locking surface 44 of the cartridge tray 43 is normally required to be locked to the locking shape 45, it is also required that this lock state is released to enable the attachment and the detachment of the cartridge tray 43. In view of this, in the present exemplary embodiment, the release of the lock state between the locking surface 44 of the cartridge tray 43 and the locking shape 45 of the main body 2 of the image forming apparatus 1 is achieved by a simple method.

Figure 11:
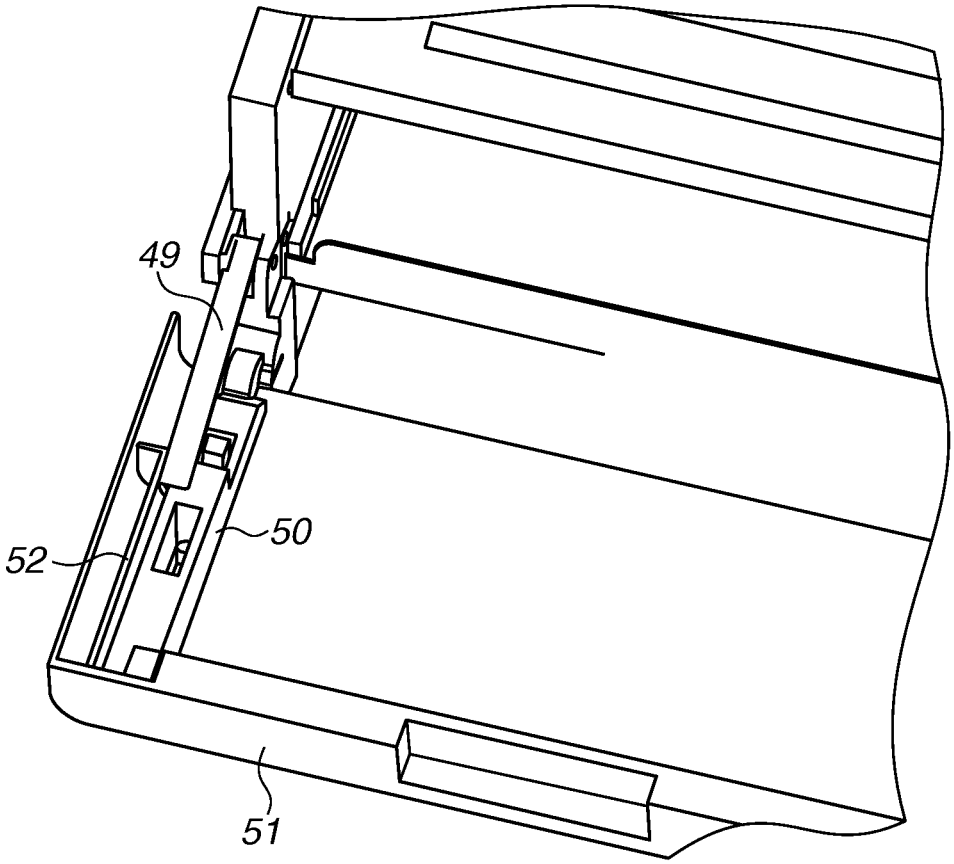
FIG. 11 is a perspective view illustrating an example in which falling of the door linkage member from a cover member is prevented.

More specifically, in the present exemplary embodiment, the lock state between the cartridge tray 43 and the locking shape 45 can also be released by releasing the engagement between the door linkage member 49 and the door hinge member 50 illustrated in FIG. 11.

As illustrated in FIG. 11, the movement of the door linkage member 49 is restricted by a fall prevention shape 52. This can prevent the engagement with the door hinge member 50 from being released, even if a deflection occurs. However, this restriction can be released by removing the cover member 51 from the openable and closable door 3.

As described above, while the openable and closable door 3 is in the closed state (see FIG. 2), the rail member 47 is placed at the lower position (see FIG. 7A). While the apparatus openable and closable door 3 is in the open state (see FIGS. 3A and 3B), the rail member 47 is placed at the upper position (see FIG. 7B).

However, by releasing the engagement between the door linkage member 49 and the door hinge member 50 illustrated in FIG. 11, the rail member 47 can be moved to the lower position (see FIG. 7A), although the openable and closable door 3 is in the open state. The specific process will be described below.

Figure 12:
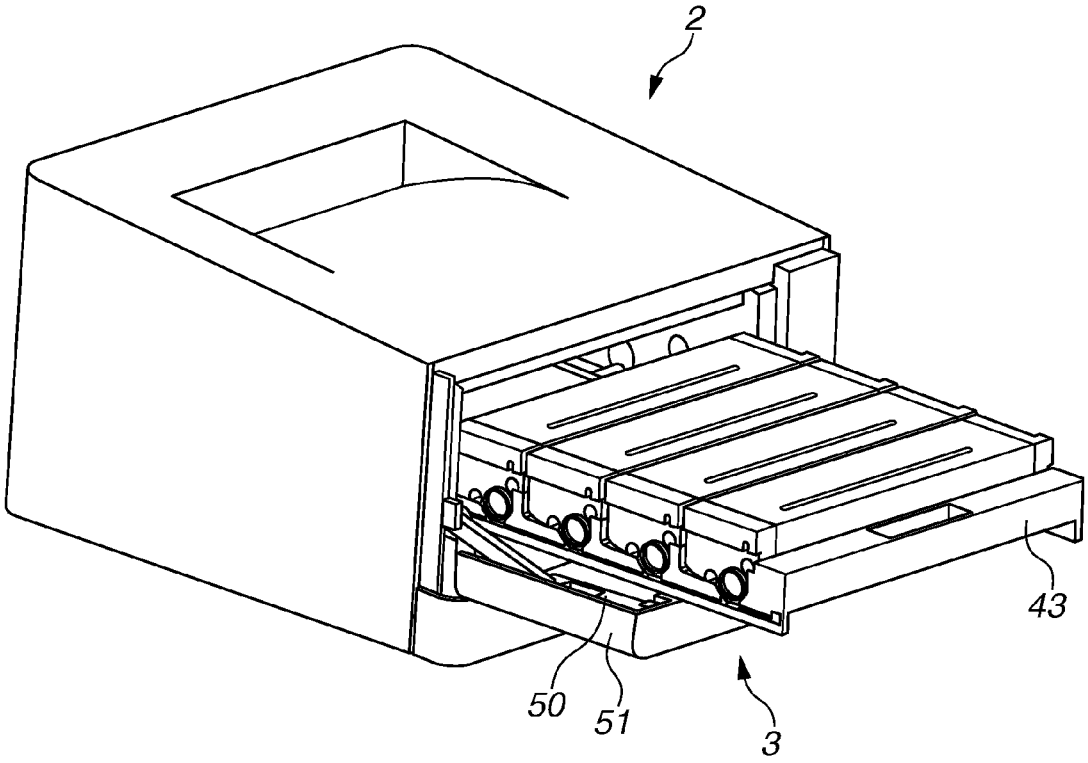
FIG. 12 is a perspective view illustrating an example in which a door for opening and closing the apparatus cannot be closed while the cartridge tray is at a pullout position.

The cartridge tray 43 is first pulled out in a normal state (in a state where the door linkage member 49 and the door hinge member 50 are engaged with each other) as illustrated in FIG. 12. In this state, the rail member 47 is still located at the upper position. This indicates the state where the locking surface 44 formed on the cartridge tray 43 is engaged with the locking shape 45 in the main body 2 of the image forming apparatus 1, as illustrated in FIG. 6.

In the state illustrated in FIG. 12, the engagement between the door linkage member 49 and the door hinge member 50 is then released.

When the engagement (connection) between the door linkage member 49 and the door hinge member 50 is released, the door linkage member 49 can freely be moved. Then, the door linkage member 49 is moved toward the direction K1 illustrated in FIG. 8. With this movement, the door linkage member 49 moves to the position where the door linkage member 49 is originally located when the openable and closable door 3 is closed, although the apparatus openable and closable door 3 is opened.

As a result, the rail member 47 moves to the lower position with the movement of the door linkage member 49, whereby the cartridge tray 43 also moves downward. This is the state illustrated in FIGS. 13 and 14.

Figure 14:
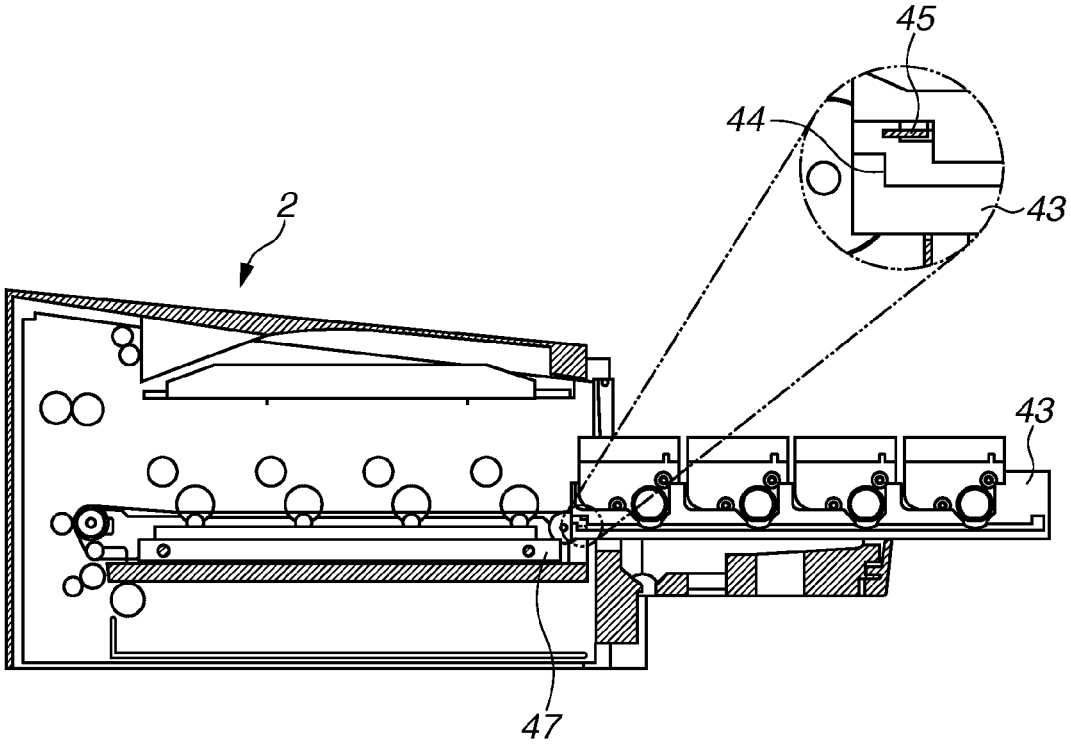
FIG. 14 is a sectional view illustrating an example of a state where locking of the cartridge tray is released.

When the cartridge tray 43 moves downward, the locking surface 44 formed on the cartridge tray 43 moves downward relative to the locking shape 45 as illustrated in FIG. 14. With this, the engagement between the locking surface 44 and the locking shape 45 is released. Therefore, the cartridge tray 43 can be detached from the main body 2 of the image forming apparatus 1. In this state, the cartridge tray 43 can also be attached to the main body 2 of the image forming apparatus 1.

The processes described above will be summarized below.

Figure 13:
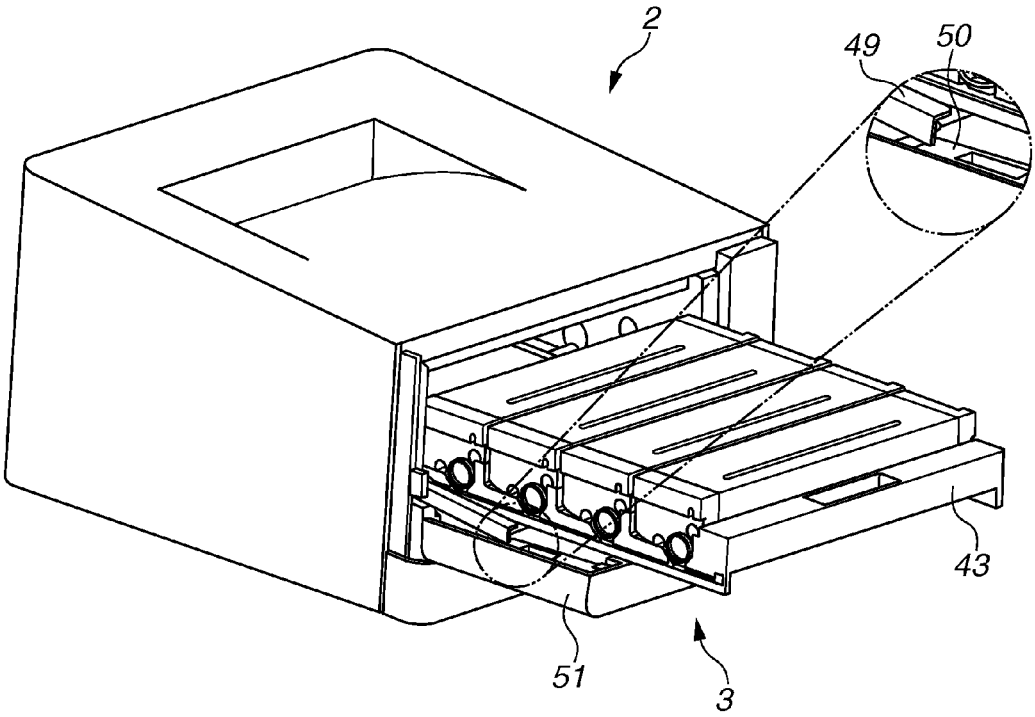
FIG. 13 is a perspective view illustrating an example of a state where locking of the door linkage member and the door hinge member is released.

First, the engagement between the door linkage member 49 and the door hinge member 50 is released while the cartridge tray 43 is located at the pullout position (see FIG. 13). With this, the linkage between the cartridge tray 43 and the openable and closable door 3 by the linkage mechanism (door hinge member 50, door linkage member 49, connection member 48, and rail member 47) can be released.

As a result, while the openable and closable door 3 is opened, moving the door linkage member 49 can move the rail member 47 and the cartridge tray 43 to the lower position. More specifically, the cartridge tray 43 can be moved downward relative to the locking shape 45 to release the locking between the locking shape 45 and the cartridge tray 43 (locking surface 44) as illustrated in FIG. 14.

The cartridge tray 43 can be further pulled from the pullout position (outside position), whereby the cartridge tray 43 can be detached from the main body 2 of the image forming apparatus 1.

In the present exemplary embodiment, the cartridge tray 43 can arbitrarily be changed to the lock state and to the detachable (attachable) state by changing the engagement state between the door linkage member 49 and the openable and closable door 3 (the linkage state between the openable and closable door 3 and the cartridge tray 43).

In general, the connection configuration from the door hinge member 50 to the rail member 47 is required in order to drive internal components of the main body 2 of the image forming apparatus 1, together with the opening and closing action of the openable and closable door 3. More specifically, the engagement configuration between the door hinge member 50 and the connection member 48 and the engagement configuration between the connection member 48 and the rail member 47 are not provided in order to attach or detach the cartridge tray 43.

According to the present exemplary embodiment, the configuration for attaching/detaching the cartridge tray 43 relative to the main body 2 of the image forming apparatus 1 and the configuration for locking the cartridge tray 43 can be provided by utilizing the existing configuration without an increase in the number of components.

Accordingly, the present exemplary embodiment achieves the locking configuration and attachment/detachment configuration of the cartridge tray 43 without an increase in the size of the main body 2 and an increase in the cost. In addition, it is unnecessary to provide elasticity to the locking shape 45 for locking the cartridge tray 43, as in the conventional art. Therefore, sufficient strength of the locking shape 45 can be ensured. This is only one example of exemplary embodiments of the present invention. For example, the attachment/detachment configuration and the engagement configuration as in the present exemplary embodiment may be provided by newly adding a component to the conventional configuration.

The foregoing exemplary embodiment has described the configuration in which the cartridge tray 43 is located at the upper position, together with the opening action of the openable and closable door 3. However, the configuration is not limited to the relationship between the opening/closing of the openable and closable door 3 and the vertical movement of the rail member 47. The exemplary embodiment is applicable to all configurations in which the cartridge tray 43 can be inserted and removed while the door linkage member 49 is in the open position, and the cartridge tray 43 can be attached to and detached from the main body 2 of the image forming apparatus 1 while the door linkage member 49 is in the close position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-192238, filed Sep. 22, 2014, which is hereby incorporated by reference herein in its entirety.

What is claimed is:

1. An image forming apparatus comprising:

a main body of the apparatus;

a cartridge support member configured to move between an inside of the main body of the apparatus and an outside position where the cartridge support member is outside of the main body of the apparatus while supporting a cartridge;

wherein when the cartridge support member is at the outside position, the cartridge is mountable to the cartridge support member;

an opening portion through which the cartridge support member passes when the cartridge support member moves between the inside of the main body of the apparatus and the outside position, the opening portion being provided in the main body of the apparatus;

an openable and closable member configured to open and close the opening portion;

a linkage mechanism configured to interlock a movement of the openable and closable member with a movement of the cartridge support member to each other, wherein in a state where the cartridge support member is inside of the main body of the apparatus, the linkage mechanism moving the cartridge support member to a first position when the openable and closable member is opened, and moving the cartridge support member to a second position different from the first position when the openable and closable member is closed; and a locking portion configured to prevent the cartridge support member from being detached from the main body of the apparatus by locking the cartridge support member which is at the outside position in a state where the linkage mechanism interlocks the movement of the openable and closable member with the movement of the cartridge support member between the first position and the second position, wherein while an interlock between the movement of the openable and closable member and the movement of the cartridge support member is released, the cartridge support member is detachable from the main body of the apparatus by releasing the locking of the cartridge support member by the locking portion.

2. The image forming apparatus according to claim 1, wherein a direction in which the cartridge support member moves between the first position and the second position crosses a direction in which the cartridge support member moves between the inside and the outside of the main body of the apparatus.

3. The image forming apparatus according to claim 1, wherein the linkage mechanism includes a holding member configured to hold the cartridge support member to guide the movement of the cartridge support member between the inside and the outside of the main body of the apparatus, and wherein the interlock between the movement of the openable and closable member and the movement of the cartridge support member is released by releasing a connection between the openable and closable member and the holding member.

4. The image forming apparatus according to claim 1, further comprising a belt member, wherein a photosensitive member provided in the cartridge is changed from a state where the photosensitive member is separated from the belt member to a state where the photosensitive member is in contact with the belt member, when the cartridge support member moves from the first position to the second position while supporting the cartridge.

5. The image forming apparatus according to claim 1, wherein the main body of the apparatus includes a positioning portion for holding the cartridge at a position where image formation is possible, and wherein the cartridge is changed from a state where the cartridge is separated from the positioning portion to a state where the cartridge is held by the positioning portion, when the cartridge support member moves from the first position to the second position while supporting the cartridge.

6. The image forming apparatus according to claim 1, wherein the cartridge support member supports a plurality of the cartridges.

7. An image forming apparatus comprising:

a main body of the apparatus;

a cartridge support member configured to move between an inside of the main body of the apparatus and an outside position where the cartridge support member is outside of the main body of the apparatus while supporting a cartridge;

wherein when the cartridge support member is at the outside position, the cartridge is mountable to the cartridge support member;

an opening portion through which the cartridge support member passes when the cartridge support member moves between the inside of the main body of the apparatus and the outside position, the opening portion being provided in the main body of the apparatus;

an openable and closable member configured to open and close the opening portion;

a movable member connected with the openable and closable member;

wherein in a state where the cartridge support member is inside of the main body of the apparatus, the movable member moving the cartridge support member to a first position when the openable and closable member is opened, and moving the cartridge support member to a second position different from the first position when the openable and closable member is closed, and a locking portion configured to lock the cartridge support member moved to the outside of the main body of the apparatus to prevent the cartridge support member from being detached from the main body of the apparatus by locking the cartridge support member which is at the outside position in a state where the movable member is connected with the openable and closable member, wherein while a connection between the movable member and the openable and closable member is released, the cartridge support member is detachable from the main body of the apparatus by releasing the locking of the cartridge support member by the locking portion.

8. The image forming apparatus according to claim 7, wherein a direction in which the cartridge support member moves between the first position and the second position crosses a direction in which the cartridge support member moves between the inside and the outside of the main body of the apparatus.

9. The image forming apparatus according to claim 7, further comprising a belt member, wherein a photosensitive member provided in the cartridge is changed from a state where the photosensitive member is separated from the belt member to a state where the photosensitive member is in contact with the belt member, when the cartridge support member moves from the first position to the second position while supporting the cartridge.

10. The image forming apparatus according to claim 7, wherein the main body of the apparatus includes a positioning portion for holding the cartridge at a position where image formation is possible, and wherein the cartridge is changed from a state where the cartridge is separated from the positioning portion to a state where the cartridge is held by the positioning portion, when the cartridge support member moves from the first position to the second position while supporting the cartridge.

11. The image forming apparatus according to claim 7, wherein the cartridge support member supports a plurality of the cartridges.

12. The image forming apparatus according to claim 1, wherein the cartridge support member moves from the first position to the second position by moving downward.

13. The image forming apparatus according to claim 1, wherein the locking of the cartridge support member by the locking portion can be released by the movement of the cartridge support member downward beyond the second position.

14. The image forming apparatus according to claim 7, wherein the cartridge support member moves from the first position to the second position by moving downward.

15. The image forming apparatus according to claim 7, wherein the locking of the cartridge support member by the locking portion can be released by the movement of the cartridge support member downward beyond the second position.

* * * * *